United States Patent [19]

Forlenza

[11] 4,296,160

[45] Oct. 20, 1981

[54] METHOD OF ZONING GRATE SURFACES

[75] Inventor: Nicholas G. Forlenza, Utica, N.Y.

[73] Assignee: Mateflex/Mele Corporation, Utica, N.Y.

[21] Appl. No.: 110,132

[22] Filed: Jan. 7, 1980

[51] Int. Cl.[3] ..... B32B 3/12

[52] U.S. Cl. ..... 428/117; 52/105; 52/181; 52/663; 273/31; 428/133; 428/139; 428/187

[58] Field of Search ..... 35/27; 46/16; 273/31, 273/29 R; 428/53, 139, 187, 117, 131, 133; 272/3; 52/227, 228, 105, 181, 663; 404/36, 40, 41; 29/452

[56] References Cited

U.S. PATENT DOCUMENTS

| | | | |
|---|---|---|---|
| 698,031 | 4/1902 | Leslie | 35/27 X |
| 3,174,411 | 3/1965 | Oestrich et al. | 404/17 |
| 3,193,434 | 7/1965 | Weiss | 428/178 X |
| 3,438,312 | 4/1969 | Becker et al. | 428/53 X |
| 3,616,104 | 10/1971 | Kuzmick | 428/17 |
| 3,960,375 | 6/1976 | Bibi-Roubi et al. | 428/116 X |
| 4,008,548 | 2/1977 | Leclerc | 428/53 X |
| 4,012,010 | 3/1977 | Friedman | 35/27 X |
| 4,045,022 | 8/1977 | Grant et al. | 273/29 R |
| 4,054,987 | 10/1977 | Forlenza | 428/53 X |

FOREIGN PATENT DOCUMENTS

| | | | |
|---|---|---|---|
| 60919 | 8/1954 | France | 46/16 |
| 386511 | 1/1933 | United Kingdom | 273/31 |

*Primary Examiner*—Henry F. Epstein
*Attorney, Agent, or Firm*—Kane, Dalsimer, Kane, Sullivan and Kurucz

[57] ABSTRACT

Disclosed is a method for delineating zones on the surface of thermoplastic gratings. The method comprises inserting in the grate openings a removable closure member adapted to interlock with the grating and close the opening. The removable closure member is distinguishable from the grating in color and when a plurality of closure members are so inserted in a pattern, they delineate a given zone.

3 Claims, 6 Drawing Figures

METHOD OF ZONING GRATE SURFACES

BACKGROUND OF THE INVENTION

1. Field of the Invention

The invention relates to a method and the means of delineating zones on the surface of thermoplastic gratings.

2. Brief Description of the Prior Art

Surfaces which comprise molded thermoplastic gratings are well known in the prior art and include for example the recreational, ball-playing surfaces described in U.S. Pat. No. 3,438,312; see also the recreational surfaces described in U.S. Pat. Nos. 3,174,411 and 3,616,104. When these surfaces are employed, for example, as tennis courts they are made up of a plurality of square, unitary, elastic, molded thermoplastic sheets having a plurality of support legs on the lower surface. The plurality of square units, which resemble grates, are interlocked together along their edges to form the tennis court; see for example U.S. Pat. No. 4,054,987.

Prior hereto, the delineation of zones such as backcourt, forecourt and sidelines of the recreational playing surfaces made up as described above was affected by making two or more different square units of a contrasting color. These contrasting color units, when properly assembled, set off or delineated different zones; see for example the delineation achieved by the method of U.S. Pat. No. 4,045,022.

The prior art methods of delineating zones on surfaces of thermoplastic gratings have not been entirely satisfactory in all respects. For example, if one wishes to change a given delineation of zones, it is necessary to disassemble the assembled surface and re-assemble it in the desired pattern of colors. The present invention obviates this particular problem of the prior art and enables one to quickly and efficiently change any given delineation without disassembly of the surface. In addition, by the method of my invention, the individual thermoplastic grates may all be molded in a single color, reducing manufacturing and inventory costs.

SUMMARY OF THE INVENTION

The invention comprises a method of delineating a zone on a surface of a thermoplastic grating, said grating comprising a molded thermoplastic sheet of a first color having an upper surface and a lower surface, a plurality of support legs on the lower surface and a plurality of openings in the sheet communicating between upper and lower surfaces, which comprises; inserting in those openings within said zone a removable closure member adapted to interlock with the grating and close the openings, said member having a second color which is visually distinguishable from the first color.

DETAILED DESCRIPTION OF THE PREFERRED EMBODIMENTS OF THE INVENTION

Those skilled in the art may readily gain an appreciation of the invention from the description of the preferred embodiments set forth below, when read in conjunction with the accompanying drawings of FIGS. 1–6, inclusive.

Figure 1:
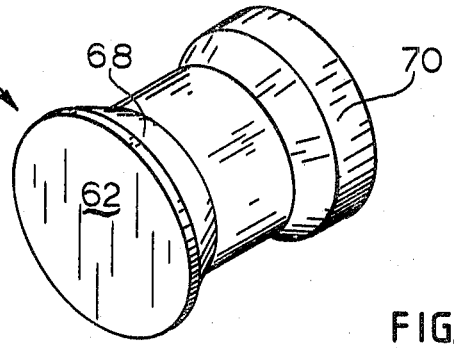
FIGS. 1 and 2 are isometric views of preferred closure members employed in the method of the invention.
Figure 2:
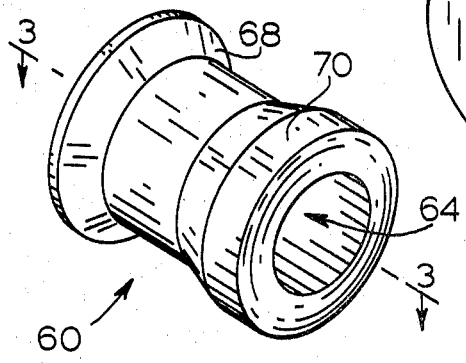

FIGS. 1 and 2 are isometric views of preferred closure members 60 which may be employed in the method of the invention. Members 60 comprise hollow cylinders having one closed end 62 and one open end 64. The members may be fabricated from any conventional material, preferably a thermoplastic, synthetic resin such as for example polyethylene, polypropylene and like resins. Although the resinous material from which members 60 are fabricated may be of any color, the end 62 must be of a visually distinguishable color from the color of the grating 14 surface described hereinafter.

As shown in FIGS. 1 and 2, end 62 of member 60 has an expanded flange 68 portion which flares from end 62 down toward the mid-section of the body of member 60. End 64 of member 60 likewise has a flange 70 which flares upwardly from the mid-section of member 60 towards the open end 64 of member 60. Flanges 68 and 70 function to secure the closure member 60 to the grating 14 as will be described more fully hereinafter.

Figure 3:
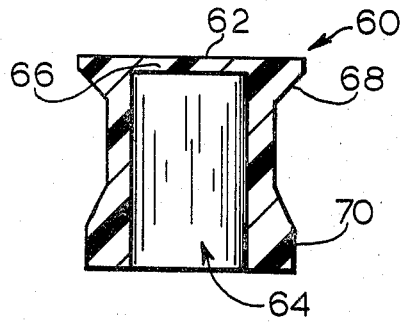
FIG. 3 is a cross-sectional, side elevation of the closure member shown in FIGS. 1 and 2.

FIG. 3 is a cross-sectional side elevation of the closure member 60 as seen in FIGS. 1 and 2 and shows further details of the closure member 60. Wall 66 closes end 62.

Figure 4:
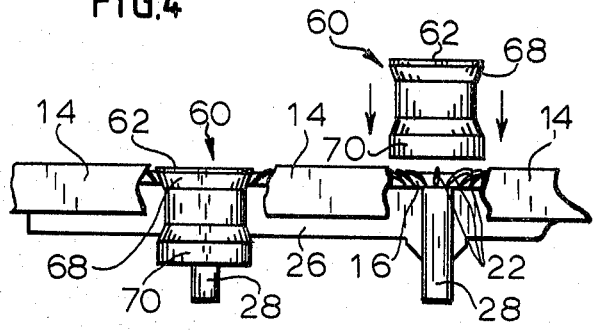
FIG. 4 is a cross-sectional side elevation-in-part of a thermoplastic grate in the process of having a zone delineated with a closure member of FIGS. 1–3.

Referring now to FIG. 4, a cross-sectional side elevation-in-part of a thermoplastic grate 14, one may see how the closure member 60 is adapted by size and configuration to close an opening 20 in the surface of grate 14.

Figure 5:
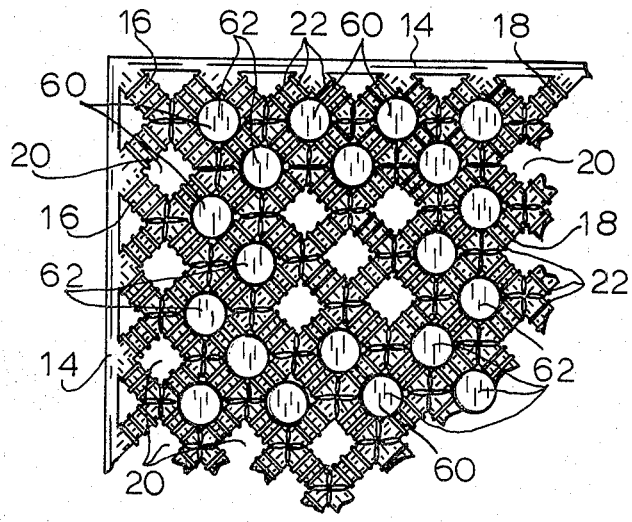
FIG. 5 is a top-view of a portion of thermoplastic grate as shown in FIG. 4, with closure members of FIGS. 1–3, in place.

Referring briefly to FIG. 5, one may observe a top view of a portion of the thermoplastic grate 14 with a plurality of members 60 closing a selected plurality of openings 20. The openings 20 in the FIG. 5 are square-shaped and are closed by the round ends 62 of the members 60. FIG. 5 shows that the grating 14 is essentially a square or rectangular sheet of thermoplastic material such as a sheet of synthetic, polymeric resin. The sheet forming the grating 14 may be, for example, a molded polyethylene, polypropylene or like synthetic polymeric resin. The grating 14 is preferably a unitary construction presenting a square configuration divided into the gratings formed by traversal of a plurality of parallel bars 16 which are integral with parallel bars 18 traveling at right angles to bars 16. The bars 16, 18 form the square openings 20 through the sheet comprising grating 14. Preferably, the openings 20 comprise about 25 to 55 percent of the total surface area of the grating 14 and are squares of a dimension within the range of from about three millimeters to thirty millimeters square, preferably not more than about fifteen millimeters square for a tennis court surface. As also shown in FIG. 5, the upper surface of the bars 16, 18 bear cross-wise ribs 22 to provide a frictional upper surface.

Referring back again to FIG. 4, it will be observed that a plurality of support legs 28 are integrally molded on the lower surface of grating 14 as a means of supporting the grating 14 off a ground surface. These support legs 28 are preferably integrally located at alternate junctures of bar 16 and bar 18 (on the lower surface). The leg 28 arrangement provides for a resilient, overall playing surface for recreational purposes. As also observed in FIG. 4, a lengthwise rib 26 is integrally molded on the underside of each bar 16, 18 to serve as a means of strengthening each bar 16, 18. In the recreational surface provided by a plurality of grates 14 assembled together, the openings 20 contribute to the overall resiliency of each sheet forming the grating 14 and also provide a means for drainage of water etc, from the upper surface of grating 14.

It will also be observed from the FIG. 4 that the removable closure members 60 fit within openings 20 by a frictional engagement or interlocking wherein flange 68 mates with and is received by the bars 16, 18. The flange 70 of closure member 60 secures against the underside of bars 16, 18 so that the closure members 60 are interlocked with the grating 14. Since however the grating 14 and closure members 60 are made of elastic, thermoplastic materials the closure members 60 are readily removable when desired by merely prying them out of the openings 20. In this way, one can rearrange the removable closure members 60 within grating 14 in any desired pattern to delinate any predetermined and desired zone.

Those skilled in the art will appreciate that although a single embodiment grating 14 has been described above, any like thermoplastic gratings such as those described in U.S. Pat. Nos. 3,438,312; 3,174,411; and 3,616,104 may be treated in accordance with the method of this invention. Generally, the gratings 14 comprise single units which are assembled together to form a larger recreational, ball playing or like recreational surface; see for example the description in U.S. Pat. No. 4,054,987.

Figure 6:
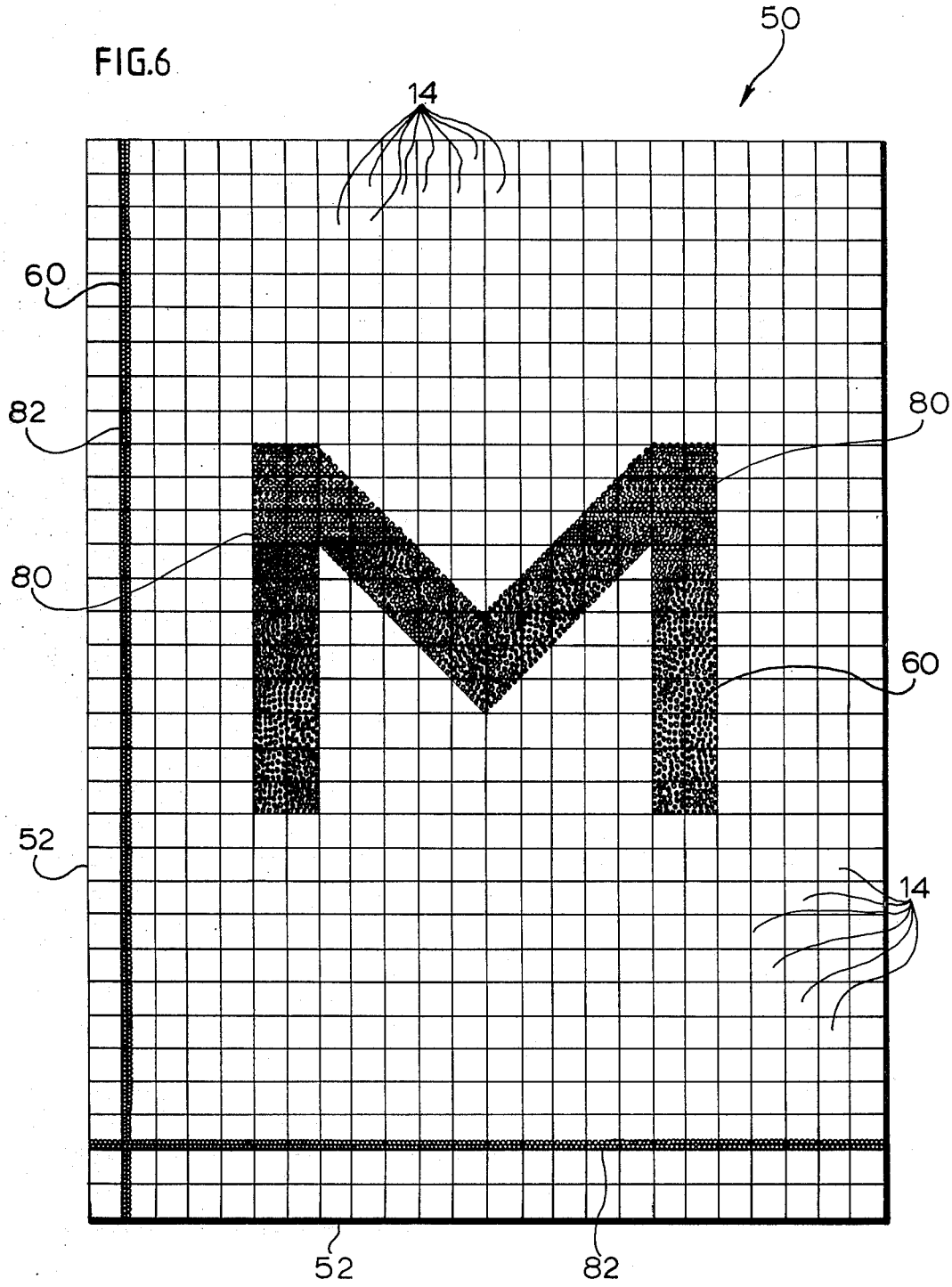
FIG. 6 is a top view of a plurality of thermoplastic gratings as shown in FIG. 5, assembled and with designated zones delineated with the closure members of FIGS. 1–3.

According to the method of the present invention, when the gratings 14 are assembled as shown in FIG. 6, a top view of a plurality of thermoplastic gratings 14 as shown in FIG. 5, assembled, one would wish to delineate certain zones for borders, playing areas, penalty areas and the like. When the thermoplastic gratings 14 are all of a single first color, the delineation of such zones may be accomplished by inserting and interlocking the closure members 60 within openings within the site of the zone to be delineated, for example, as shown in the recreational surface 50 of FIG. 6, a border 82 has been delineated along edges 52 of the recreational surface 50 by inserting and interlocking a plurality of the removable closure members 60 in the desired pattern. From the FIG. 6 it will also be appreciated that delineation of a particular zone need not be only for forming borders and guidelines but may be employed to provide indicia such as indicia 80 on the surface of the recreational surface 50. These indicia may be changed from time to time by simply rearranging the pattern of closure members 60 within the thermoplastic gratings 14.

I claim:

1. A method of delineating a zone on a surface of a thermoplastic grating, said grating comprising a molded thermoplastic sheet of a first color having an upper surface and a lower surface, a plurality of support legs on the lower surface and a plurality of square openings in the sheet communicating between upper and lower surfaces, the sheet portions between said square holes being bars defining the edges of adjacent holes, which comprises; inserting in those openings within said zone a removable closure member adapted to interlock with the grating and close the openings, said member having a second color which is visually distinguishable from the first color, said member comprising a cylinder having a first closed end and a second end, and expanded flange portions on each of said first and second ends, said flange portions flaring toward the mid-section of the cylinder shaped member, said interlocking occurring when the flanges frictionally engage the bars.

2. A thermoplastic grating having a surface with delineated zones, which comprises;

a molded thermoplastic sheet of a first color having an upper surface and a lower surface and a plurality of square openings in the sheet communicating between the upper and lower surfaces, the sheet portions between said square holes being bars defining the edges of the adjacent holes; and a plurality of removable closure members inserted and interlocked in those openings which are within the zone to be delineated, said members having a second color which is visually distinguishable from the first color, said member comprising a cylinder having a first closed end and a second end, and expanded flange portions on each of said first and second ends, said flange portions flaring toward the mid-section of the cylinder shaped member, said interlock being formed by frictional engagement of the flanges with the bars.

3. The grating of claim 2 wherein said sheet is supported on a plurality of support legs integrally molded on the lower side.

* * * * *